US009547272B2

(12) United States Patent
Ito et al.

(10) Patent No.: US 9,547,272 B2
(45) Date of Patent: Jan. 17, 2017

(54) CLEANING BLADE AND CLEANING DEVICE

(71) Applicant: CANON KABUSHIKI KAISHA, Tokyo (JP)

(72) Inventors: Shingo Ito, Tokyo (JP); Kenji Karashima, Tokyo (JP); Masaya Kawada, Abiko (JP); Tomohiro Tanoue, Yokohama (JP); Masahiro Watabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/924,480

(22) Filed: Oct. 27, 2015

(65) Prior Publication Data

US 2016/0124376 A1 May 5, 2016

(30) Foreign Application Priority Data

Oct. 30, 2014 (JP) ..... 2014-222033

(51) Int. Cl.
*G03G 21/00* (2006.01)
*B08B 1/00* (2006.01)
*B41F 1/00* (2006.01)

(52) U.S. Cl.
CPC ..... *G03G 21/0017* (2013.01); *B08B 1/005* (2013.01); *B08B 1/006* (2013.01); *B41F 1/00* (2013.01)

(58) Field of Classification Search
CPC ..... B08B 11/00; G03G 21/0017
See application file for complete search history.

(56) References Cited

U.S. PATENT DOCUMENTS 4,639,123 A * 1/1987 Adachi ..... G03G 21/0011 15/256.51
5,438,400 A * 8/1995 Kuribayashi ..... G03G 21/0017 15/256.5
5,550,622 A * 8/1996 Tange ..... G03G 21/0011 101/169
2011/0052288 A1* 3/2011 Koido ..... G03G 21/0029 399/351
2014/0321880 A1 10/2014 Karashima et al.

FOREIGN PATENT DOCUMENTS

JP 2010-281974 A 12/2010
JP 2013-190642 A 9/2013

* cited by examiner

*Primary Examiner* — Randall Chin
(74) *Attorney, Agent, or Firm* — Canon U.S.A. Inc., IP Division

(57) ABSTRACT

To provide a cleaning blade having an elastic body portion containing urethane rubber and a support member supporting the elastic body portion.

A free end portion of the elastic body has a first region in which the Young's modulus gradually decreases in the depth direction from the principal surface facing the surface of the member to be cleaned on the edge face side and a second region in which the Young's modulus does not vary in the depth direction from the principal surface on the side closer to the support member relative to the first region.

6 Claims, 9 Drawing Sheets

CLEANING BLADE AND CLEANING DEVICE

BACKGROUND OF THE INVENTION

Field of the Invention

The present invention relates to a cleaning blade and a cleaning device.

Description of the Related Art

In general, after a toner image formed on the surface (outer peripheral surface) of an electrophotographic photoconductor (hereinafter also simply referred to as a "photoconductor") is transferred to a transfer material or an intermediate transfer body or also after a toner image is further transferred to a transfer material from an intermediate transfer body, toner is likely to partially remain on the surface of the photoconductor and/or the intermediate transfer body. Therefore, the toner remaining on the surface of the photoconductor or the intermediate transfer body needs to remove. The removal is usually performed by a cleaning blade. As the cleaning blade, a blade like (plate like) one having a thickness (width) of 0.5 mm or more and 3 mm or less and a length in the longitudinal direction of a surface facing a member to be cleaned (a photoconductor, an intermediate transfer body, and the like) longer than the thickness is used, for example.

The cleaning blade is attached to a metal holder and is fixed thereto for use in an electrophotographic apparatus, for example. The cleaning blade is disposed in such a manner that an edge portion (front edge ridgeline portion) of the cleaning blade contacts a member to be cleaned. For the cleaning blade, a cleaning blade formed from urethane rubber is frequently used because the wear resistance, the grade of permanent deformation, and the like are excellent. As toner which has been developed in order to meet a demand for an improvement of image quality in recent years, toner having a small particle diameter and high sphericity (close to a spherical shape) is known. The toner having a small particle diameter and high sphericity has a feature that the transfer efficiency is relatively high and can meet the demand for the improvement of image quality.

However, even when it is attempted to remove the toner having a small particle diameter and high sphericity from the surface of the member to be cleaned using the cleaning blade, the toner having a small particle diameter and high sphericity is difficult to sufficiently remove, so that faulty cleaning occurs in some cases. This is because the toner having a small particle diameter and high sphericity is more likely to pass through a small gap formed between the cleaning blade and the member to be cleaned as compared with toner not having a small particle diameter and high sphericity.

In order to suppress the passing-through of such toner, it is effective to increase the contact pressure between the cleaning blade and the member to be cleaned to reduce the gap.

However, as an increase in the contact pressure between the cleaning blade and the member to be cleaned, there is a tendency for the frictional force between the cleaning blade and the member to be cleaned to be higher.

Then, as an increase in the frictional force between the cleaning blade and the member to be cleaned, the cleaning blade is more likely to be pulled in the moving direction of the surface of the member to be cleaned, so that an edge portion of the cleaning blade is turned up in some cases.

When the cleaning blade resists the turning-up force to return to the original state, an abnormal sound (squeaking) generates in some cases. Particularly in a high temperature and high humidity environment, the adhesion force between the cleaning blade and the member to be cleaned increases to increase the turning-up degree of the edge portion, so that the squeaking is likely to generate.

In order to suppress such squeaking, it is effective to increase the hardness of a cleaning blade contact portion to reduce the frictional force between the cleaning blade and the member to be cleaned to suppress minute vibration.

When the hardness of the surface layer of the cleaning blade is higher, the true contact area with the member to be cleaned surface becomes smaller, so that the frictional force decreases. Japanese patent Laid-Open No. 2010-281974 describes a technique of forming a hard surface layer having a cleaning blade front edge ridgeline portion on one side on the edge face which is a face parallel to the thickness direction of the cleaning blade in such a manner that the layer thickness becomes uneven in the longitudinal direction of the cleaning blade.

Moreover, Japanese Patent Laid-Open No. 2013-190642 describes a technique of providing a cleaning blade having two layers different in 100% modulus, in which a coat layer having a high 100% modulus is provided on an edge portion.

The present invention is directed to providing a cleaning blade in which squeaking does not generate under severe conditions where toner and external additives are hardly supplied and in which surface layer peeling of the cleaning blade and passing-through due to insufficient following properties to unevenness of the surface of a member to be cleaned and foreign substances which may be present on the surface thereof are hard to occur.

Moreover, the present invention is directed to providing a cleaning blade in which vibration of an elastic body portion which is brought into contact with a member to be cleaned is hard to be transmitted to a support member and the contact state to the member to be cleaned of the elastic body portion can be stabilized.

Furthermore, the present invention is directed to providing a cleaning device capable of stably cleaning the surface of a member to be cleaned.

SUMMARY OF THE INVENTION

According to first aspect of the present invention, there is provided a cleaning blade for cleaning a surface of a member to be cleaned by bringing the elastic body portion into contact with the surface of the member to be cleaned, having an elastic body portion containing urethane rubber and a support member supporting the elastic body portion, in which a free end portion of the elastic body portion has a first region in which the Young's modulus gradually decreases in the depth direction from the principal surface facing the surface of the member to be cleaned on the edge face side and a second region in which the Young's modulus does not vary in the depth direction from the principal surface on a side closer to the support member relative to the first region, and when the Young's moduli of the principal surface and at a position at a depth of 20 μm and a position at a depth of 50 μm from the principal surface are defined as $Y_0$, $Y_{20}$, and $Y_{50}$, respectively, in the first region, the average rate of variation of the Young's modulus $\Delta Y_{0\text{-}20}$ between the principal surface and a position at a depth of 20 μm from the principal surface is represented by the following expression (5), the average rate of variation of the Young's modulus $\Delta Y_{20\text{-}50}$ between a position at a depth of 20 μm from the principal surface and the position at the depth of 50 μm from the principal surface is represented by the following expression (6), and the Young's modulus of the surface in the second region on the same plane as the principal surface is defined as $P_0$, the relationships of the following expressions (1), (2), (3), and (4) are satisfied;

$$10\ \text{mgf}/\mu\text{m}^2 \leq Y_0 \leq 400\ \text{mgf}/\mu\text{m}^2 \quad (1),$$

$$Y_{50}/Y_0 \leq 0.5 \quad (2),$$

$$\Delta Y20\text{-}50 \leq \Delta Y0\text{-}20 \quad (3),$$

$$P0 < Y0 \quad (4),$$

$$\Delta Y_{0\text{-}20} = \{(Y_0 - Y_{20})/Y_0\}/(20-0)\ \mu\text{m} \quad (5), \text{ and}$$

$$\Delta Y_{20\text{-}50} = \{(Y_{50} - Y_{20})/Y_{20}\}/(50-20)\ \mu\text{m} \quad (6).$$

According to another aspect of the present invention, there is provided a cleaning device having the above-described cleaning blade.

Further features of the present invention will become apparent from the following description of exemplary embodiments with reference to the attached drawings.

DESCRIPTION OF THE EMBODIMENTS

Figure 1:
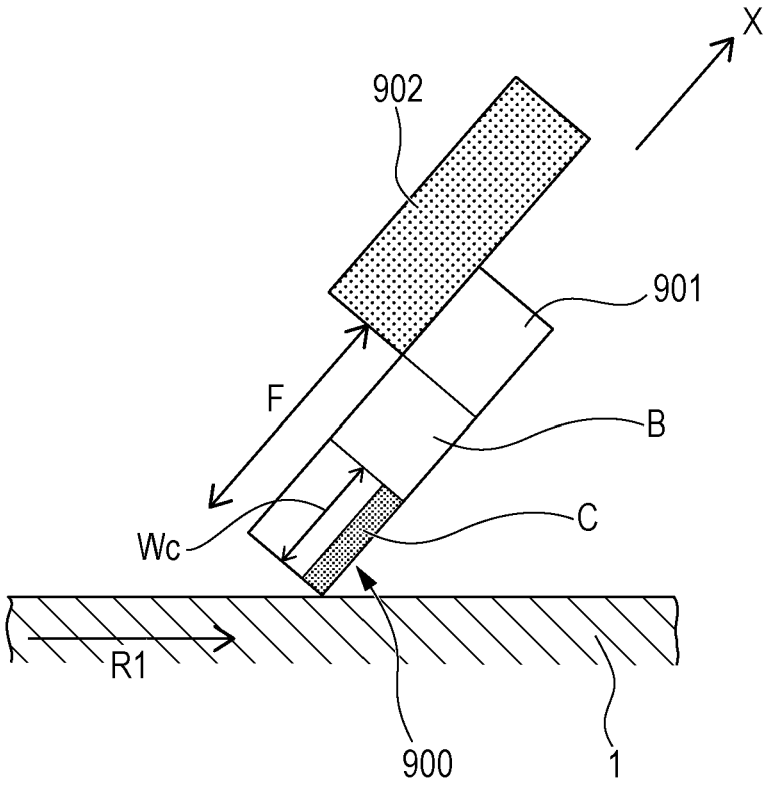
FIG. 1 is a view illustrating the shape of a cleaning blade and the relationship between a free length F and a region C.

According to an examination of the present inventors, with the techniques described in Japanese Patent Laid-Open Nos. 2010-281974 and 2013-190642, low friction properties cannot be maintained under severe conditions where toner and external additives are hardly supplied to a cleaning nip, so that it has been hard to completely suppress squeaking.

As a method for maintaining low friction under the above-described severe conditions, it is considered to further increase the hardness of the front edge of a cleaning blade. In that case, however, a difference in the hardness with the hardness of a base layer has become excessively large, so that cracking in the surface layer of the cleaning blade has occurred or the surface layer has been peeled in some cases. Moreover, the cleaning blade has not followed surface unevenness of the member to be cleaned, and thus passing-through of toner from a gap formed there has occurred in some cases. Then, as a result of a further examination by the present inventors, the present inventors have found that a cleaning blade having the configuration according to the present invention is effective for overcoming the above-described problems.

The present invention relates to a cleaning blade having an elastic body portion containing urethane rubber and a support member supporting the elastic body portion and cleaning the surface of the member to be cleaned by bringing the elastic body portion into contact with the surface of the member to be cleaned.

A free end portion of the elastic body portion has a first region in which the Young's modulus gradually decreases in the depth direction from the principal surface facing the surface of the member to be cleaned on the edge face side and a second region in which the Young's modulus does not vary in the depth direction from the principal surface on the side closer to the support member relative to the first region.

When the Young's moduli of the principal surface and a position at a depth of 20 μm and a position at a depth of 50 μm from the principal surface are defined as $Y_0$, $Y_{20}$, and $Y_{50}$, respectively, in the first region, the average rate of variation of the Young's modulus $\Delta Y_{0\text{-}20}$ between the principal surface and the position at the depth of 20 μm from the principal surface is represented by the following expression (5), the average rate of variation $\Delta Y_{20\text{-}50}$ of the Young's moduli between the position at the depth of 20 μm from the principal surface and the position at the depth of 50 μm from the principal surface is represented by the following expression (6), and the Young's modulus of the surface in the second region on the same plane as the principal surface is defined as $P_0$, the relationships of the following expressions (1), (2), (3), and (4) are satisfied;

$$10\ \text{mgf}/\mu\text{m}^2 \leq Y_0 \leq 400\ \text{mgf}/\mu\text{m}^2 \quad (1),$$

$$Y_{50}/Y_0 \leq 0.5 \quad (2),$$

$$\Delta Y20\text{-}50 \leq \Delta Y0\text{-}20 \quad (3),$$

$$P0 < Y0 \quad (4),$$

$$\Delta Y_{0\text{-}20} = \{(Y_0 - Y_{20})/Y_0\}/(20-0)\ \mu\text{m} \quad (5), \text{ and}$$

$$\Delta Y_{20\text{-}50} = \{(Y_{50} - Y_{20})/Y_{20}\}/(50-20)\ \mu\text{m} \quad (6).$$

Figure 7A:
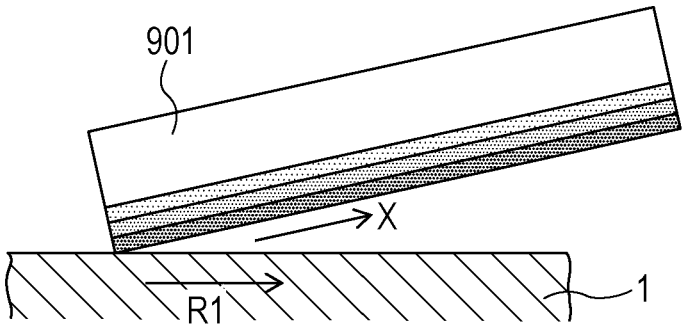
FIG. 7A is a schematic view illustrating a difference in the magnitude of the Young's modulus of a cleaning blade by the color gradation.

In the cleaning blade, the depth direction, the longitudinal direction, and the width direction are directions indicated by a Z direction, a Y direction, and an X direction, respectively, in FIG. 7A. The "principal surface" is the surface (XY surface) of the cleaning blade facing the surface of the member to be cleaned.

The present inventors have conducted an extensive research, and, as a result, have found that, by appropriately controlling the Young's modulus of the surface and the inside of a limited region (hereinafter also referred to as "region C") containing an contact portion (hereinafter also referred to as "contact portion of a cleaning blade" or also simply referred to as "contact portion") of the principal surface facing the member to be cleaned in the cleaning blade, a cleaning blade is obtained in which squeaking resulting from vibration of the cleaning blade is suppressed and surface layer peeling does not occur and which is excellent in the following properties to unevenness of the surface of the member to be cleaned or to foreign substances which may be present on the surface (hereinafter also simply referred to as "following properties to unevenness and foreign substances").

Support Member

In the cleaning blade, materials of the support member supporting the elastic body portion containing urethane rubber are not particularly limited insofar as rigidity required for the support member of the cleaning blade is given to the support member. As specific examples, metals, such as a stainless steel alloy, are mentioned.

Figure 2A:
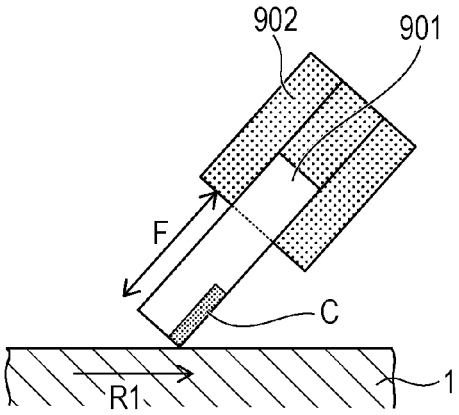
FIGS. 2A to 2C are views illustrating another configuration example of a cleaning blade.
Figure 2B:
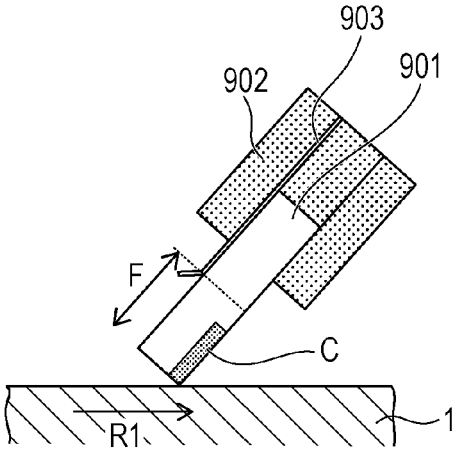
Figure 2C:
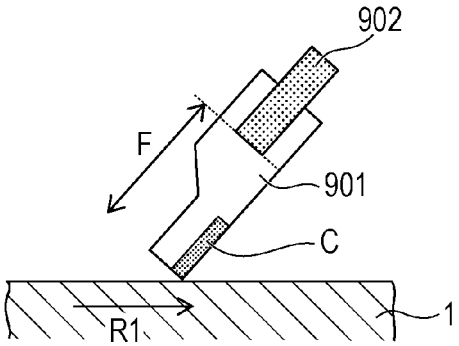

As the structure of the support member, a plate like body illustrated in FIG. 1 and FIG. 2C, a shape in which the elastic body portion is held between combined plates illustrated in FIG. 2A, and the like are mentioned.

Member to be Cleaned

As the member to be cleaned which is a cleaning target of the cleaning blade, a photoconductor, an intermediate transfer body, a transfer roll, and the like in an electrophotographic apparatus are mentioned.

Cleaning Blade

The cleaning blade (hereinafter also simply referred to as "blade") has the elastic body portion containing urethane rubber and the support member supporting the elastic body portion. The cleaning blade has a first region in which the Young's modulus gradually decreases under predetermined conditions in the depth direction from the principal surface (Reference Numeral 900 of FIG. 1) facing the surface of the member to be cleaned and a second region on a side closer to the support member relative to the first region in a free end portion of the elastic body portion.

In the first region, the Young's modulus $Y_0$ of the principal surface is 10 mgf/μm$^2$ or more and 400 mgf/μm$^2$ or less. By setting the Young's modulus $Y_0$ of the surface of the region C to 10 mgf/μm$^2$ or more, vibration of the cleaning blade contact portion can be suppressed. There are two reasons therefor.

As a first reason, this is because a ultramicroscopic contact point (true contact area) of the cleaning blade and the member to be cleaned relating to the friction therebetween decreases by setting the surface Young's modulus $Y_0$ to 10 mgf/μm$^2$ or more, so that the frictional force of pulling the front edge (free end) of the blade to the downstream in the movement direction of the member to be cleaned decreases. As a second reason, this is because the contact portion has a high Young's modulus, and therefore the deformation amount of the blade in the movement direction of the member to be cleaned is suppressed to a small degree.

Figure 9A:
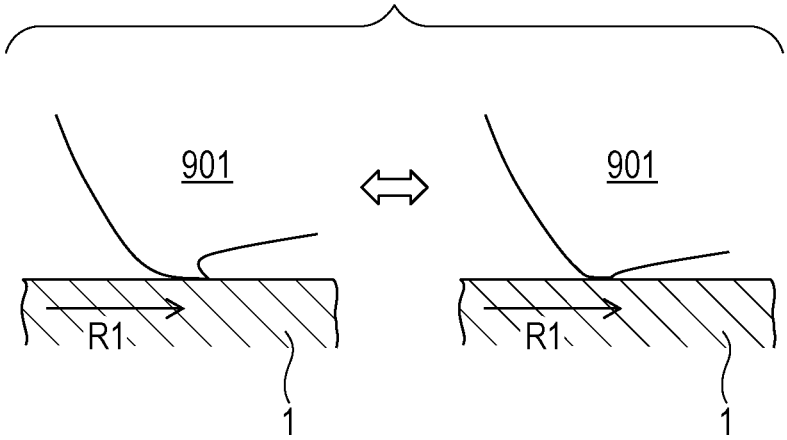
FIG. 9A is a schematic view illustrating the contact state of a cleaning blade when Y0 is less than 10 mgf/μm$^2$.
Figure 9B:
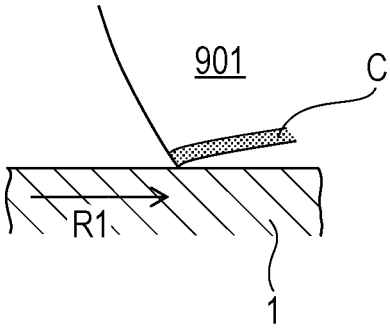
FIG. 9B is a schematic view illustrating the contact state of a cleaning blade when Y0 is 10 mgf/μm$^2$ or more.

As illustrated in FIG. 9A, when the surface Young's modulus $Y_0$ is less than 10 mgf/μm$^2$, the front edge of the blade is pulled to the downstream in the movement direction (R1 in FIG. 9A) of the member to be cleaned, so that the bade is easily deformed. Or, by repeating the recovery from the deformation at a high frequency of thousands of Hz, squeaking easily generates. On the other hand, when the surface Young's modulus $Y_0$ is 10 mgf/μm$^2$ or more, the blade front edge and the member to be cleaned always contact each other in the state where the deformation of the blade front edge is small as illustrated in FIG. 9B for the two reasons described above, and thus the motion of the blade front edge is small and particularly squeaking of a high frequency is difficult to generate.

The second region is a region where the Young's modulus does not substantially vary in the depth direction from the surface (the same plane as the above-described principal surface). As illustrated in FIG. 1, due to the presence of the region (hereinafter also referred to as "region B") containing low-hardness rubber in which the Young's modulus hardly varies in the depth direction from the surface on a side closer to the support member 902 relative to the region C, the transmission of vibration of a low frequency of about hundreds of Hz generated due to nonuniformity and the like of the surface friction properties of the member to be cleaned to the support member 902 can be prevented, and thus blade squeaking can be synthetically stopped.

In the region B, the Young's modulus hardly varies in the depth direction from the surface but the Young's modulus may vary in terms of manufacturing. Therefore, in the present invention, a case where the rate of variation from the minimum value $Y_{min}$ to the maximum value $Y_{max}$ of the Young's modulus in the depth direction "$(Y_{max}-Y_{min})/Y_{max}\times 100$" is less than 30% is regarded as "The Young's modulus does not vary in the depth direction from the principal surface."

The Young's modulus $P_0$ of the principal surface of the region B needs to be lower than the Young's modulus $Y_0$ of the surface of the region C in order to attenuate the vibration and is suitably 5 mgf/μm$^2$ or less. From the viewpoint of increasing the following properties to unevenness and foreign substances by applying a pressure to the blade front edge, the Young's modulus $P_0$ is suitably 1 mgf/μm$^2$ or more.

A width Wc of the region C needs to be larger at least than the nip width in which the blade contacts the photoconductive drum. In the blade in which the $Y_0$ is 10 mgf/μm$^2$ or more, the nip width is at most tens of μm or less even when the blade is subjected to an endurance test, and therefore the width Wc of the region C may be tens or more and 100 μm or less. The upper limit of the width Wc of the region C is less than the blade free length. The region B needs to be present in the entire region in the longitudinal direction of the blade and suppress vibration of a low frequency transmitted through the region C from the contact portion. The configuration of the blade includes some types besides the configuration illustrated in FIG. 1 and examples of the other configurations are illustrated in FIGS. 2A to 2C.

A mark F in FIGS. 2A to 2C denotes the blade free length. When the free length F is longer, the blade can more flexibly contact a member 1 to be cleaned. Therefore, the contact pressure is easily stabilized against unevenness of the contact load or the position change of the member 1 to be cleaned due to deformation of the device. On the other hand, when the free length F is excessively long, the contact pressure applied to the front edge of the blade becomes excessively small or the blade is easily turned over. Therefore, the free length F is usually set to a value of about 4 mm to about 12 mm. The thickness of the blade is usually about 0.5 mm to about 3 mm. The cleaning blade illustrated in FIG. 2A is a type in which a plate like elastic body portion 901 is held with a support member 902. FIG. 2B illustrates a type in which a metal backboard 903 is further disposed on the back surface of the elastic body portion of the holding type of FIG. 2A to adjust the free length F to be short. FIG. 2C illustrates a type in which the elastic body portion 901 and the support member 902 are integrally molded and the free length of the blade of the structure is defined as a length on the blade edge face side relative to the support member 902 as illustrated FIG. 2C.

Figure 3:
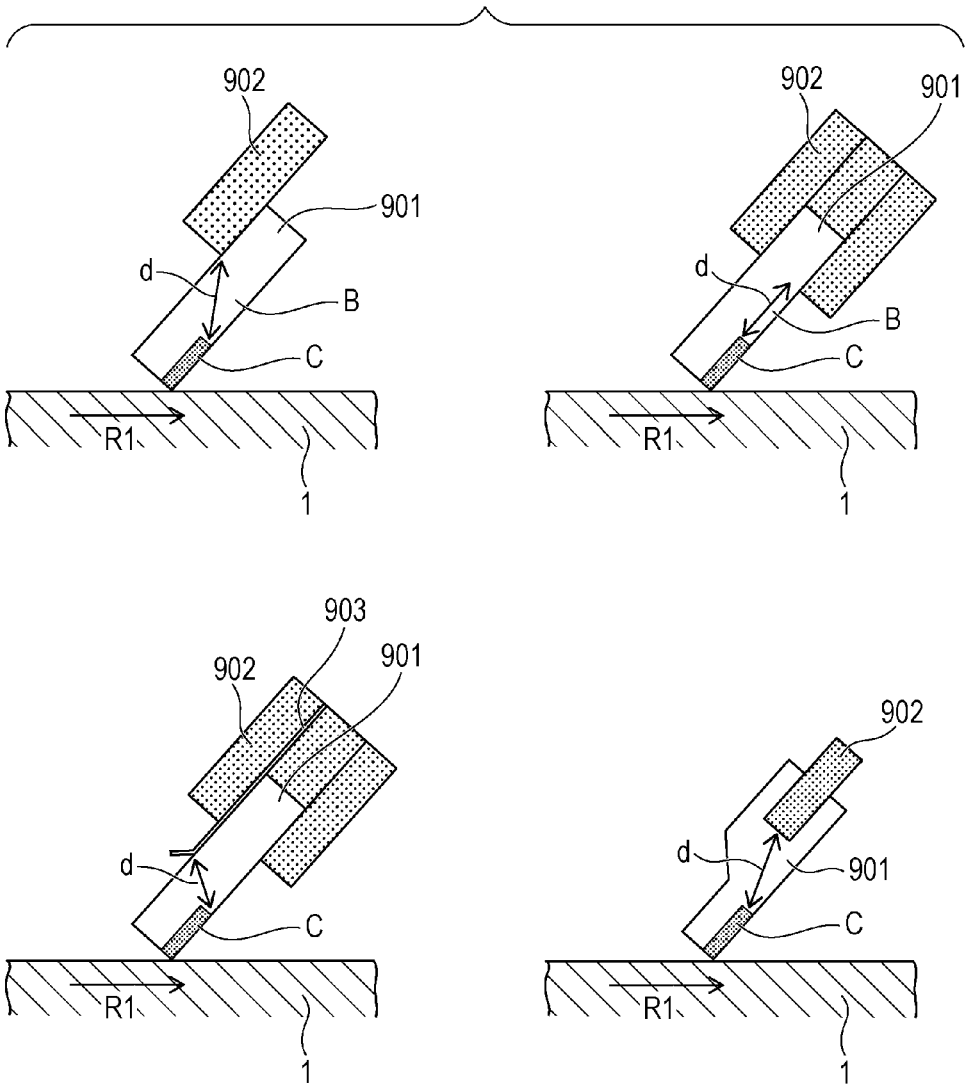
FIG. 3 includes views illustrating a distance d between the region C and a support member in various cleaning blades.

FIG. 3 includes vies illustrating the "shortest distance d" between the back end of the region C and the support member 902 about each blade shape. In order for the region B to attenuate the vibration transmitted through the region C from the contact portion, it is required for the region B to have a width to some extent to secure the shortest distance d between the back end of the region C and the support member 902. Specifically, when the shortest distance d of 4 mm or more is secured, low frequency vibration can be more effectively suppressed. The shortest distance d between the back end of the region C and the support member 902 is suitably 10 mm or less in order to secure the blade contact pressure and due to limitations in terms of a manufacturing method.

The cleaning blade is configured so that the Young's modulus of the surface of the region C is increased to some extent (10 mgf/μm$^2$ or more and 400 mgf/μm$^2$ or less) and also that the Young's modulus gradually decreases towards the inside from the surface of the contact portion. Specifically, the cleaning blade is configured so that the ratio "$Y_{50}/Y_0$" of the Young's modulus $Y_{50}$ at a position at the depth of 50 μm from the surface of the contact portion of the cleaning blade to the surface Young's modulus $Y_0$ is 0.5 or less. Thus, even when the Young's modulus of the surface of the contact portion is increased to some extent, the following properties of the cleaning blade to unevenness and foreign substances of the member to be cleaned is good. The Young's modulus ratio "$Y_{50}/Y_0$" is suitably 0.2 or less. Setting the Young's modulus $Y_0$ within the range of 10 mgf/μm$^2$ or more and 400 mgf/μm$^2$ or less and also setting the ratio "$Y_{50}/Y_0$" to 0.5 or less means sharply reducing the Young's modulus in the depth direction from the surface of the contact portion of the cleaning blade.

As a result of an examination of the present inventors, it has been found that the surface layer peeling of the cleaning blade is likely to occur in a portion where stress applied to the cleaning blade concentrates. It has also been found that the concentration of the stress is likely to occur on the interface of layers when the cleaning blade is configured from a plurality of layers different in the Young's modulus and a portion where the Young's modulus sharply varies in the cleaning blade.

Then, as described above, the cleaning blade is configured so that the Young's modulus sharply decreases in the depth direction from the surface of the contact portion (and the region C). In the portion, the cleaning blade is configured so that the Young's modulus particularly sharply decreases near the surface of the contact portion. Specifically, the cleaning blade is configured so that the average rate of variation of the Young's modulus $\Delta Y_{0\text{-}20}$ from the surface of the contact portion to the position at the depth of 20 μm is equal to or higher than the average rate of variation of the Young's modulus $\Delta Y_{20\text{-}50}$ from the position at the depth of 20 μm to the position at the depth of 50 μm. More specifically, the cleaning blade is configured in such a manner as to satisfy the relationship "$\Delta Y_{20\text{-}50} \leq \Delta Y0-_{20}$".

Thus, even when the Young's modulus becomes sharply small from the surface of the contact portion towards the inside (position at the depth of 50 μm from the surface), the surface layer peeling of the cleaning blade is difficult to occur. Moreover, the following properties of the cleaning blade to unevenness of the surface of the member to be cleaned or foreign substances which may be present on the surface becomes good. This is considered to be because, by configuring the cleaning blade so that the Young's modulus sharply decreases near the surface where a stress due to deformation of the cleaning blade is high and the Young's modulus gently decreases on the inner side, the stress due to the deformation is dispersed.

Moreover, as described above, the cleaning blade is configured so that the Young's modulus ratio "$Y_{50}/Y_0$" is 0.5 or less but, more suitably, the cleaning blade is configured so that the Young's modulus ratio "$Y_{20}/Y_0$" is 0.5 or less. Thus, the following properties of the cleaning blade to unevenness of the surface of the member to be cleaned or foreign substances which may be present on the surface becomes better.

It is desirable that, when a graph in which the horizontal axis represents the distance from the principal surface and the vertical axis represents the Young's modulus in the first region is drawn, the Young's modulus $Y_N$ at an arbitrary position (position N μm apart from the principal surface) in the range from the principal surface to the position at the depth of 50 μm is located under the straight line connecting the Young's modulus $Y_0$ and the Young's modulus $Y_{50}$. $0<N<50$ [μm] is established.

This means that the profile of variation in the Young's modulus at each position in the depth direction from the surface of the contact portion of the cleaning blade is in a downward projected shape. Thus, the following properties of the cleaning blade to unevenness of the surface of the member to be cleaned or foreign substances which may be present on the surface becomes better.

Figure 7B:
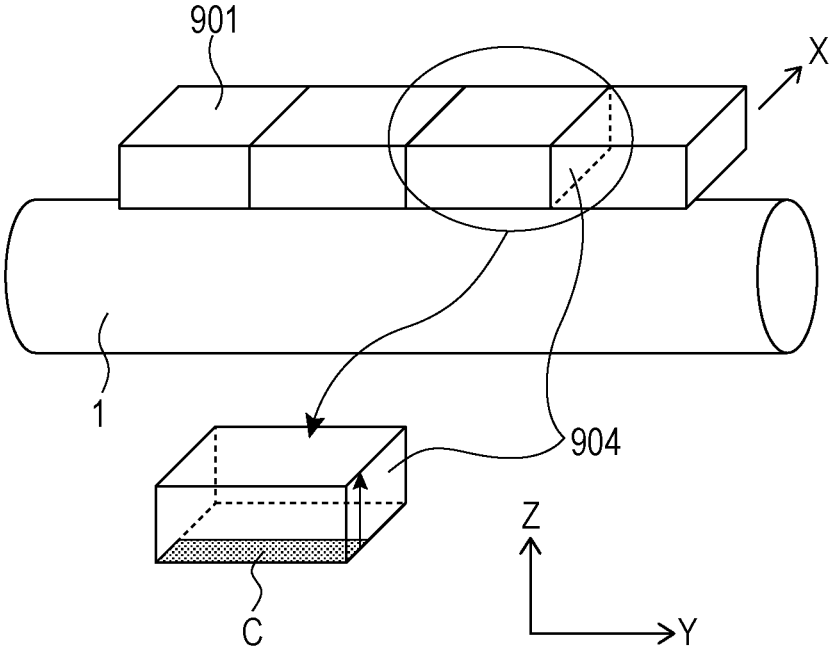
FIG. 7B is a schematic view illustrating a place where the Young's modulus of a cleaning blade is measured.

FIG. 7A is a schematic view illustrating a difference in the magnitude of the Young's modulus of the cleaning blade by the color gradation. FIG. 7B is a schematic view illustrating positions where the Young's modulus of the cleaning blade is measured. The load of deforming the contact portion of the cleaning blade becomes a stress in the direction (Direction X indicated by the arrow in FIG. 7A) along the surface facing the member to be cleaned of the cleaning blade. In the cleaning blade of FIG. 7A, a deeper color portion has higher Young's modulus. In the case where the Young's modulus near the contact portion is high, the deformation amount becomes small even when stress is applied in the direction X. FIG. 7A illustrates that the Young's modulus of the cleaning blade gradually varies for convenience of description but the variation in the Young's modulus is not limited to the stepwise variation and may be continuous variation in the present invention.

The variation of the Young's modulus of the cleaning blade is more suitably continuous variation than stepwise variation. The continuous variation means that the interface between portions different in the Young's modulus where peeling and chipping are likely to occur is not present in the cleaning blade.

Urethane Rubber

As a method for increasing the Young's modulus of the contact portion of the elastic body portion containing urethane rubber, it is effective to control the molecular structure of the urethane rubber in the contact portion. The urethane rubber can be synthesized using polyisocyanate, polyol, a chain extender (for example, multifunctional polyol), and a catalyst for urethane rubber synthesis, for example.

When the urethane rubber is polyester urethane rubber, polyester polyol may be used as the polyol in order to synthesize the polyester urethane rubber. When the polyester urethane rubber is aliphatic polyester urethane rubber, aliphatic polyester polyol may be used as the polyol in order to synthesize the aliphatic polyester urethane rubber.

Examples of a more specific method for increasing the Young's modulus of the contact portion of the elastic body portion containing urethane rubber include a method including varying the degree of cross-linkage of the urethane rubber or a method including controlling the molecular weight of raw materials of the urethane rubber. As a suitable method, a method including blending an isocyanurate group in the urethane rubber to increase the concentration of the isocyanurate group is mentioned. The isocyanurate group can be blended in the urethane rubber as a group derived from polyisocyanate which is a raw material of the urethane rubber.

The elastic body portion suitably contains urethane rubber containing an isocyanurate group in terms of the ease of control of the Young's modulus of the surface of the contact portion. In that case, in order to increase the Young's modulus of the surface of the contact portion of the elastic body portion, it is suitable to increase the content of the isocyanurate group on the surface (and in the vicinity) of the urethane rubber in the contact portion.

Specifically, when the urethane rubber is polyester urethane rubber, the IR spectrum is first measured by a μATR method on the surface of the polyester urethane rubber in the contact portion. In that case, it is suitable that a ratio "ISI/ISE" of an intensity ISI of the C—N peak derived from the isocyanurate group in the polyester urethane rubber to an intensity ISE of the C═O peak derived from an ester group in the polyester urethane rubber is 0.50 or more.

The C—N peak is the peak at 1411 $cm^{-1}$ and the C═O peak is the peak at 1726 $cm^{-1}$. The ratio "ISI/ISE" is based on the intensity of the C═O peak derived from an ester group which is not influenced by the amount of the isocyanurate group. The ratio "ISI/ISE" is a parameter which allows qualitative measurement of the amount of the isocyanurate group by comparing the standard and the intensity of the C—N peak derived from the isocyanurate group.

Examples of a method for supporting the elastic body portion containing urethane rubber include a method including bonding the elastic body portion to the support member, a method including sandwiching the elastic body portion between a plurality of support members, and the like, for example. Moreover, as other methods for supporting the elastic body portion, a method (a method including using a part of the elastic body as a support portion) including forming the elastic body on the front edge of the support member and the like are mentioned, for example.

The urethane rubber configuring the cleaning blade according to the present invention is suitably polyester urethane rubber from the viewpoint of mechanical strength, such as wear resistance, and the difficulty of permanent deformation due to the contact pressure (creeping resistance). In particular, aliphatic polyester urethane rubber is more suitable.

As a method for controlling the Young's modulus of the contact portion of the cleaning blade as described above, it is effective to control the molecular structure of the urethane rubber.

The urethane rubber can be synthesized using polyisocyanate, high molecular weight polyol, a chain extender (for example, low molecular weight multifunctional polyol), and a catalyst for urethane rubber synthesis, for example. In order to synthesize the polyester urethane rubber, polyester polyol may be used as the polyol. In order to synthesize the aliphatic polyester urethane rubber, aliphatic polyester polyol may be used as the polyol.

Specific examples of a method for controlling the Young's modulus of the contact portion of the elastic body portion containing urethane rubber as described above include a method including varying the degree of cross-linkage of the urethane rubber, a method controlling the molecular weight of the raw materials of the urethane rubber, and the like. Among the methods above, the method including setting the concentration of the isocyanurate group derived from polyisocyanate which is the raw material of the urethane rubber in such a manner that the concentration is higher in portions closer to the surface of the urethane rubber is suitable from the viewpoint of the accuracy of the control of the Young's modulus.

As the polyisocyanate, the following substances are mentioned, for example. Mentioned are 4,4'-diphenyl methane diisocyanate (4,4'-MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide modified MDI, polymethylene polyphenyl isocyanate (PAPI), and the like. Among the above, 4,4'-diphenyl methane diisocyanate is suitable.

As the high molecular weight polyol (aliphatic polyester polyol), the following substances are mentioned, for example. Mentioned are ethylene butylene adipate polyester polyol, butylene adipate polyester polyol, hexylene adipate polyester polyol, lactone polyester polyol, and the like. Two or more kinds thereof may be used in combination. Among the aliphatic polyester polyols, butylene adipate polyester polyol and hexylene adipate polyester polyol are suitable because the crystallinity is high. When the crystallinity of the aliphatic polyester polyol is higher, the hardness of the polyester urethane rubber to be obtained becomes higher, so that the endurance of the cleaning blade can be increased.

The number average molecular weight of the high molecular weight polyol is suitably 1500 or more and 4000 or less and more suitably 2000 or more and 3500 or less. When the number average molecular weight of the polyol is larger, the hardness, the elastic modulus, and the tensile strength of the urethane rubber (i.e., cleaning blade) to be obtained become higher. When the number average molecular weight is smaller, the viscosity becomes lower, so that the handling becomes easier.

Examples of the chain extender (low molecular weight multifunctional polyol) include glycols mentioned below, for example. Mentioned are ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexane dimethanol, xylylene glycol (telephthalyl alcohol), triethylene glycol, and the like. As chain extenders other than glycols, trivalent or higher polyhydric alcohols, such as trimethylol propane, glycerol, pentaerythritol, and sorbitol, are mentioned, for example. Two or more kinds thereof may be used in combination.

The catalysts for urethane rubber synthesis are roughly divided into urethanization catalysts (reaction promotion catalyst) for promoting rubberization (resinification) and foaming and isocyanurating catalysts (isocyanate trimerizing catalyst). Two or more kinds thereof may be used in combination.

Examples of the urethanization catalysts include the following substances, for example. Mentioned are tin urethanization catalysts, such as dibutyltin dilaurate and stannous octoate, amine urethanization catalysts, such as triethylene diamine, tetramethyl guanidine, pentamethyl diethylene triamine, dimethyl imidazole, tetramethyl propane diamine, N,N,N'-trimethylaminoethylethanolamine, and the like. Two or more kinds thereof may be used in combination. Among the urethanization catalysts, triethylene diamine is suitable in terms of particularly promoting a urethane reaction.

Examples of the isocyanurating catalysts include the following substances, for example. Mentioned are metal oxides, such as $Li_2O$ and $(Bu_3S)_2O$; hydrite compounds, such as $NaBH_4$; alkoxide compounds, such as $NaOCH_3$, KO-(t-Bu), and borates; amine compounds, such as $N(C_2H_5)_3$, $N(CH_3)_2CH_2C_2H_5$, and $N_2C_6H_{12}$; alkaline carboxylate salt compounds, such as $HCO_2Na$, $CO_3(Na)_2$, $PhCO_2Na$/DMF, $CH_3CO_2K$, $(CH_3CO_2)_2Ca$, alkaline soap, and naphthenic acid salt; quarternary ammonium salt compounds, such as an alkaline formate compound and $((R^1)_3—NR^2OH)—OOCR^3$; and the like. As combined catalysts (co-catalysts) to be used as the isocyanurating catalysts, amine/epoxide, amine/carboxylic acid, amine/alkylene imide, and the like are mentioned, for example. Two or more kinds thereof may be used in combination.

Among the catalysts for urethane rubber synthesis, N,N,N'-trimethyl aminoethyl ethanolamine is suitable which also independently shows the action of the isocyanurating catalyst in addition to the action as the urethanization catalyst.

Moreover, additives, such as a pigment, a plasticizer, a waterproof agent, an antioxidant, an ultraviolet absorber, and a light stabilizer, can also be used in combination as necessary.

Manufacturing of Cleaning Blade

The present inventors have found that, by synthesizing the urethane rubber by the following method, the distribution of the isocyanurate group can be controlled as described above. More specifically, a method is mentioned which includes using aliphatic polyester polyol, applying an isocyanurating catalyst to the inner surface of a die, and then charging a raw material in which the ratio of the polyisocyanate to the aliphatic polyester polyol is within a specific range into the die, and then synthesizing urethane rubber.

By applying the isocyanurating catalyst to the inner surface of the die, the isocyanurating reaction of the raw material contacting the catalyst-applied portion of the inner surface of the die among the raw materials for urethane rubber synthesis is particularly promoted. Therefore, it is suitable to use an excessive amount of polyisocyanate based on the aliphatic polyester polyol. Furthermore, the isocyanurating catalyst applied to the inner surface of the die and the temperature of the die act on the excessive amount of polyisocyanate, so that urethane rubber in which the distribution of the isocyanurate group is controlled as described above is synthesized. By partially applying the isocyanurating catalyst to a specific portion of the inner surface of the die, the range and the shape of a portion to be isocyanurated in a molded article (cleaning blade) of the urethane rubber can be controlled.

The use amount (the number of moles) of the aliphatic polyester polyol to the polyisocyanate is suitably 30% by mol or more and 40% by mol or less based on the number of moles of the polyisocyanate. When the amount of the aliphatic polyester polyol is smaller, the effect obtained by setting the amount of the polyisocyanate to an excessive amount is more easily obtained and it becomes easier to control the Young's modulus $Y_0$ of the surface of the contact portion of the cleaning blade to 10 mgf/μm$^2$ or more. On the other hand, by suppressing the degree of the excessive amount of the polyisocyanate, it becomes easy to control the Young's modulus $Y_0$ of the surface of the contact portion of the cleaning blade to 400 mgf/μm$^2$ or less.

The temperature of the die is set suitably in the range of 80° C. or higher and 150° C. or lower and more suitably in the range of 100° C. or higher and 130° C. or lower. In order to cause the raw materials to react with each other in the die to synthesize urethane rubber, the temperature of the die is suitably high to some extent from the viewpoint of the reaction speed. However, there is a tendency for a difference in the Young's moduli between the surface of the contact portion of the cleaning blade and the inside thereof becomes smaller when the temperature of the die becomes higher.

As a method for manufacturing the urethane rubber for cleaning blades, a centrifuge molding method, a cast press method, and the like are mentioned in addition to the above-described methods. The centrifuge molding method is a method including charging raw materials for urethane rubber synthesis into a drum-shaped die, and then applying centrifugal force thereto. The cast press method is a method including charging a raw material for urethane rubber synthesis into a belt-shaped or groove-shaped die.

Cleaning Device

The cleaning blade can be used as a cleaning device having the cleaning blade. As the configuration of the cleaning device, a constant load system in which the front edge of the cleaning blade is pressed against the surface of the member to be cleaned at a constant load with the power of a spring and a constant displacement system in which the cleaning blade is fixed to the frame of the cleaning device, so that the position does not vary.

According to one aspect of the present invention, a cleaning blade is provided in which squeaking is hard to generate under severe conditions where toner and external additives are hardly supplied and in which surface layer peeling and passing-through due to insufficient following properties to surface unevenness of a member to be cleaned and foreign substances which may be present on the surface thereof is hard to occur.

Moreover, according to one aspect of the present invention, a cleaning blade can be obtained in which vibration of an elastic body portion which is brought into contact with a member to be cleaned is hard to be transmitted to a support member and the contact state to the member to be cleaned of the elastic body portion can be stabilized.

Furthermore, according to one aspect of the present invention, a cleaning device which demonstrates stable cleaning effects can be obtained.

EXAMPLES

Hereinafter, the present invention is described with reference to Examples. In Examples, "part(s)" means "part(s) by mass". Evaluation methods are as follows.

1. Measurement of Young's Modulus

The Young's modulus of a cleaning blade was measured using a minute indentation hardness tester ENT-1100 (Trade name) manufactured by Elionix, Inc. In appropriate points from the surface of a contact portion of the cleaning blade towards the inside, a loading-unloading test is performed under the following conditions, and then the Young's modulus (composite elastic modulus) is obtained as the calculation result of the tester.

Test mode: Loading-Unloading test
Load range: A
Test load: 100 [mgf]
Number of times of division: 1000 [time]
Step interval: 10 [m second]
Load retention time: 2 [second]

FIG. 7B is a schematic view illustrating places where the Young's modulus of the cleaning blade is measured.

First, the cleaning blade was cut at three places in the longitudinal direction to equally divide the longitudinal direction into four sections. Then, the measurement and the calculation described above were performed in a direction from the surface of the contact portion towards the inside (Direction Z in FIG. 7B) at arbitrary portions of the region C (gray region in the lower view of FIG. 7B) in three cut surfaces 904.

Specifically, the measurement and the calculation described above were performed from the surface of the contact portion towards the inside in increments of 2 μm from the surface to a position at a depth of 60 μm, in increments of 10 μm from a position at a depth of 60 μm to a position at a depth of 100 μm, and in increments of 20 μm from a position at a depth of 100 μm to a position at a depth of 300 μm. Then, at each measurement position, the value obtained by averaging the measured values at the three cut surfaces was used as the value of the Young's modulus at each position. In principle, the Young's modulus is a value larger than 0. Also in the region B portion, the Young's modulus (P0) was similarly measured.

2. Measurement of IR Spectrum by μATR Method

The measurement of the IR spectrum by a μATR method was performed using a Fourier transform infrared spectroscopic device (Trade name: Perkin Elmer Spectrum One/Spotlight300) manufactured by Perkin Elmer, Inc. (Universal ATR with diamond crystal). ISI/ISE was determined.

3. Evaluation of Squeaking and Passing-Through

As an evaluation machine, a copying machine manufactured by CANON KABUSHIKI KAISHA (Trade name: iR-ADVC5255) was used. A cleaning portion was converted in such a manner that the above-described holding type blade was able to be attached thereto. Then, two kinds of photoconductor drums of a photoconductor drum having the same dimension as that of a drum-shaped photoconductor (hereinafter also referred to as "photoconductor drum") for the copying machine and having a concave portion with a diameter of 40 μm and a depth of 2.5 μm formed with an area ratio of 50% on the surface (hereinafter also referred to as "concave photoconductor drum") and a photoconductor drum whose surface is smoothened (hereinafter also referred to as "smooth photoconductor drum") were prepared.

3-1. Evaluation of Squeaking

The smooth photoconductor drum was mounted on the copying machine, and then the cleaning blade obtained as described above was disposed in such a manner that the contact surface (surface facing a surface to which a catalyst liquid was applied of the inner surface of a die) contacted the photoconductor drum in a counter direction. The blade contacting conditions to the photoconductor drum were set to a set angle of 22° and a contact pressure of 28 gf/cm. Then, an endurance test of 50000 sheets was performed at a discharge current of 100 μA without performing development in a high temperature and high humidity environment of a temperature of 30° C. and a relative humidity of 80% to evaluate squeaking of the cleaning blade.

The evaluation criteria are as follows:

A: No squeaking occurs after passing 50000 sheets;

B: No squeaking occurs until 20000 sheets are passed but slight squeaking sometimes occurs in stopping or in starting drive on and after 20000 sheets are passed;

C: Slight squeaking, which does not cause practical problems, sometimes occurs in stopping or in starting drive before 20000 sheets are passed;

D: Squeaking occurs in stopping or in starting drive before 20000 sheets are passed;

E: Squeaking always occurs immediately after starting the endurance test or turning-up of the blade occurs.

3-2. Evaluation of Passing-Through

In a low temperature and low humidity environment of a temperature of 15° C. and a relative humidity of 10%, the concave photoconductor drum was mounted on the copying machine, and then melamine resin particles (Trade name: Optobeads, 3.5 μm in diameter, manufactured by Nissan Chemical Industries, Ltd.) were applied onto the surface of the photoconductor drum. Then, the passing-through of the melamine resin particles (substitute for toner) was evaluated as the evaluation of the cleaning performance. When the following properties of the cleaning blade to the melamine resin particles present on the surface concave portion and the surface of the photoconductor drum is better, the passing-through of the melamine resin particles becomes more difficult to occur. Since the ease of passing-through is determined by the following properties to unevenness of the front edge of the blade, only the blade which was isocyanurated in a 1 mm portion of the blade front edge was evaluated. The evaluation results are shown in Table 4.

The evaluation criteria are as follows:

A: No passing-through of the melamine resin particles occurs;

B: The passing-through of the melamine resin particles are observed on a surface on the downstream side of the cleaning blade (surface facing the photoconductor drum);

C: In a part of the surface of the photoconductor drum, stripe-shaped passing-through of the melamine resin particles which can be visually distinguished occurs;

D: On the entire surface of the photoconductor drum, the passing-through of the melamine resin particles which can be visually distinguished occurs.

Example 1

1. Process of Obtaining First Composition 299 parts of 4,4'-diphenyl methane diisocyanate (hereinafter also referred to as "4,4'-MDI") and 767.5 parts of butylene adipate polyester polyol (hereinafter also referred to as "BA2600") having a number average molecular weight of 2600 were made to react at 80° C. for 3 hours to give a first composition (prepolymer) containing 7.2% by mass of NCO group.

2. Process of Obtaining Second Composition

To 300 parts of hexylene adipate polyester polyol (hereinafter also referred to as "HA2000") having a number average molecular weight of 2000, 0.25 part of N,N,N'-trimethyl amino ethyl ethanolamine (hereinafter also referred to as "ETA") as a catalyst for urethane rubber synthesis was added, and then the mixture was stirred at 60° C. for 1 hour to give a second composition.

3. Process of Obtaining Mixture

The first composition was warmed to 80° C., the second composition warmed to 60° C. was added thereto, and then the mixture was stirred to give a mixture of the first composition and the second composition. The number of moles of the polyol in the second composition was 17% by mol based on the number of moles of the polyisocyanate in the first composition. Hereinafter, the ratio is also referred to as "M(OH/NCO)". In this example, the M(OH/NCO) is 17% by mol.

4. Process of Obtaining Cleaning Blade Containing Urethane Rubber

A part of the inner surface of a die for manufacturing a cleaning blade (5 mm in width, in the entire region in the longitudinal direction) was coated with a 10μ thick polyvinylidene chloride sheet. Then, a catalyst liquid prepared by mixing 100 parts of ETA in 100 parts of ethanol was spray-applied to the inner surface of the die. Thereafter, the catalyst liquid was spread to the inner surface of the die with a blade containing urethane rubber.

Then, the die was heated to 110° C., the sheet was removed, a release agent was applied to a surface (including the portion coated with the sheet) to which the catalyst liquid was not applied of the inner surface of the die, the die was heated to 110° C. again, and then the die was stabilized at the temperature.

Thereafter, the mixture was injected into the die (inside of a cavity). After the injection, the die was heated at 110° C. (molding temperature) for 30 minutes for curing reaction, then the mixture was released from the die, so that a "urethane rubber plate a" was obtained. The urethane rubber plate a was cut with a cutter in such a manner as to include an isocyanurated portion (2 mm in width and 345 mm in length) of the obtained urethane rubber plate a to form an edge portion, so that a "urethane rubber plate b" for cleaning blade was obtained. The obtained urethane rubber plate b had a size of 2 mm in thickness, 13 mm in width, and 345 mm in length and was isocyanurated in only a 2 mm portion of the front edge in the vicinity of the edge.

Similarly, 4 kinds of urethane rubber plates b in total in which the isocyanurated-portion width was varied were created by changing the ETA application range and the places to be cut. The isocyanurated portion widths each are 1 mm, 2 mm, 4 mm, and 6 mm. Each urethane rubber plate (elastic body portion) 901 was put into a blade support member 902 as illustrated in FIG. 2A and fixed therein to be used as a cleaning device. Since the free length F was 8 mm, the distances each between the region C and the support member 902 were 7 mm, 6 mm, 4 mm, and 2 mm.

The manufacturing conditions and the M(OH/NCO) are shown in Tables 1 and 2.

The obtained four kinds of cleaning blades were measured for the Young's modulus and the IR spectrum. The obtained results (Young's modulus and Average value of $I_{SI}/I_{SE}$) are shown in FIG. 4 and Table 3.

Figure 4A:
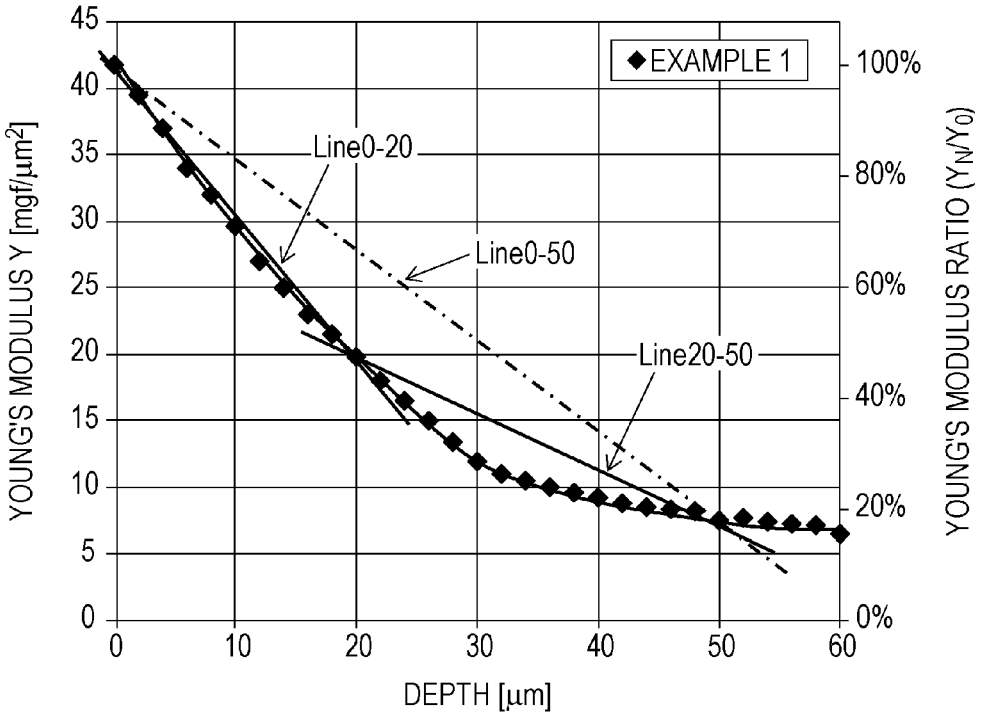
FIGS. 4A and 4B show the evaluation results of the Young's modulus of a cleaning blade of Example 1.
Figure 4B:
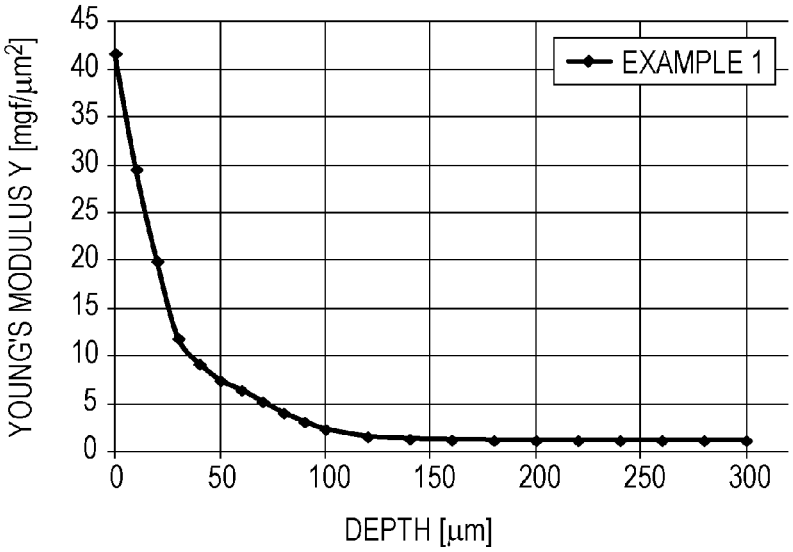

In FIG. 4A, the straight line connecting the Young's modulus $Y_0$ and the Young's modulus $Y_{50}$ is indicated as $L_{0\text{-}50}$, the straight line connecting the Young's modulus $Y_0$ and the Young's modulus $Y_{20}$ is indicated as $L_{0\text{-}20}$, and the straight line connecting the Young's modulus $Y_{20}$ and the Young's modulus $Y_{50}$ is indicated as $L_{20\text{-}50}$. The Young's modulus $Y_0$ of the cleaning blade of Example 1 was 41.8 mgf/μm$^2$, the $Y_{50}/Y_0$ was 0.18, and the $Y_{20}/Y_0$ was 0.48. $\Delta Y_{0\text{-}20} \geq \Delta Y_{20\text{-}50}$ can be grasped from the inclination of $L_{0\text{-}20}$ and $L_{20\text{-}50}$. It is also found that the Young's modulus $Y_N$ is located under $L_{0\text{-}50}$ and the profile of variations of the Young's modulus from the surface of the contact portion towards the inside was in a downward projected shape. The $I_{SI}/I_{SE}$ was 0.50. The evaluation results of squeaking and the evaluation results of passing-through are shown in Table 4.

Examples 2 to 8 and Comparative Examples 1 and 2

Figure 5A:
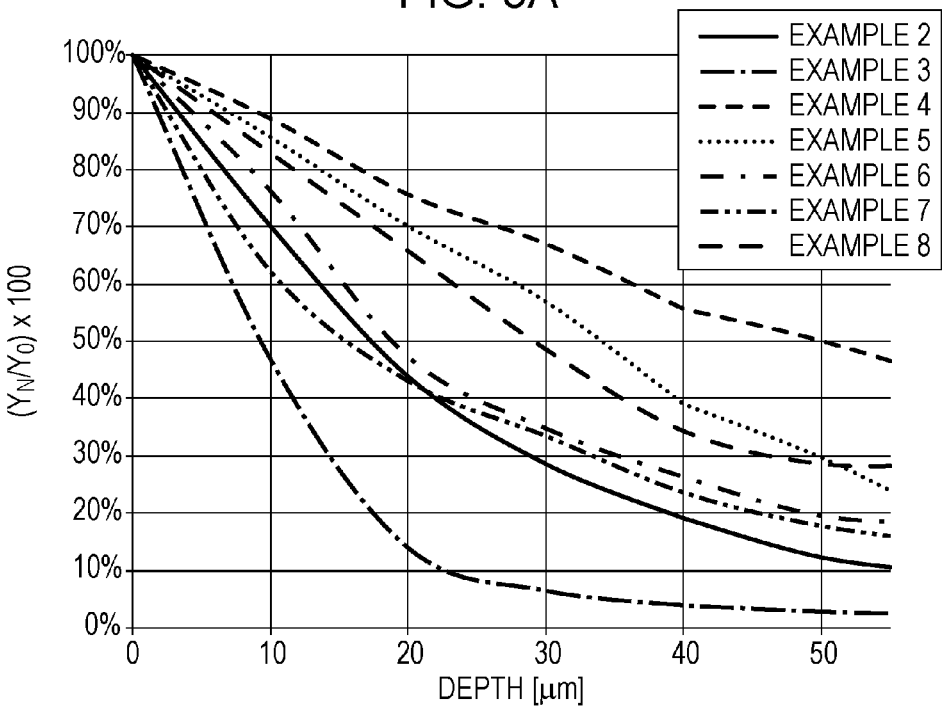
FIG. 5A shows the evaluation results of the Young's modulus of cleaning blades of Examples 2 to 8.
Figure 5B:
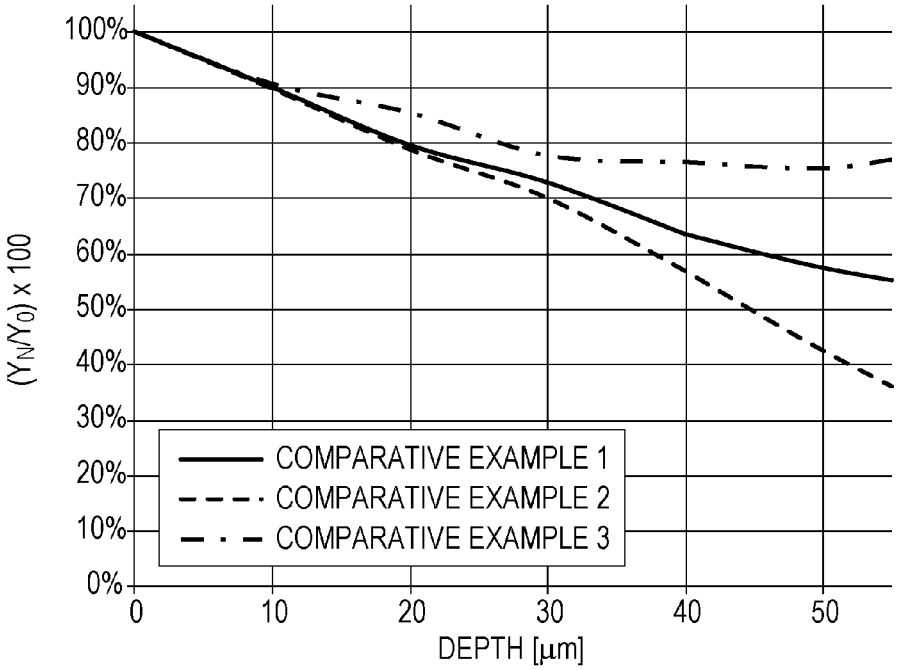
FIG. 5B shows the evaluation results of the Young's modulus of Comparative Examples 1 to 3.

In Example 1, either or all of the composition of the first composition, the composition of the second composition, the molding temperature, and the composition of the catalyst liquid was/were changed as shown in the conditions shown in Table 1 and 2. Except the changes, four kinds of cleaning blades different in the isocyanurated-portion width were manufactured and each evaluation was performed in the same manner as in Example 1. Each manufacturing condition and each evaluation result are shown in FIGS. 5A and 5B and Tables 3 and 4.

The DABCO-TMR used in the preparation of the catalyst liquid is a compound represented by the following chemical formula (D) (Trade name: DABCO-TMR, manufactured by Sankyo Air Products Co., Ltd.). The UCAT-18X is a special amine (Trade name: UCAT-18X, manufactured by San-Apro Ltd.). The POLYCAT46 is CH3COOK (Trade name: POLYCAT46, manufactured by Air Products).

(D)

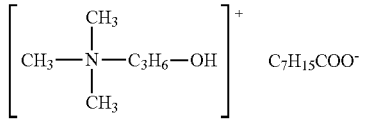

Comparative Example 3

An urethane rubber plate was manufactured in the same manner as in Example 1, except not applying a catalyst liquid to the inner surface of a die in Example 1. More specifically, the application of the catalyst liquid to the inner surface of the die in [4. Process of obtaining cleaning blade containing urethane rubber] of Example 1 was not performed but a release agent was applied to the entire inner surface of the die, and then molding was performed.

Next, the manufactured urethane rubber plate was dipped in 4,4'-MDI warmed to 80° C. for 30 minutes, and then pulled up. Four kinds of blades in which the widths of urethane rubber plates to be dipped each were varied to 1 mm, 2 mm, 4 mm, and 6 mm from the front edge were created. Thereafter, 4,4'-MDI adhering to the surface of the urethane rubber plates was wiped off with ethanol. Thereafter, the urethane rubber plates were allowed to stand for 2 days in a high humidity environment of a temperature of 25° C. and a relative humidity of 90%, the 4,4'-MDI permeating into the surface of the urethane rubber plates which was not able to be wiped off was subjected to water addition treatment, and the resultant urethane rubber plates were used as cleaning blades of Comparative Example 3. The manufacturing conditions and the evaluation results are shown in FIG. 5B and Tables 3 and 4.

Comparative Example 4

Figure 6A:
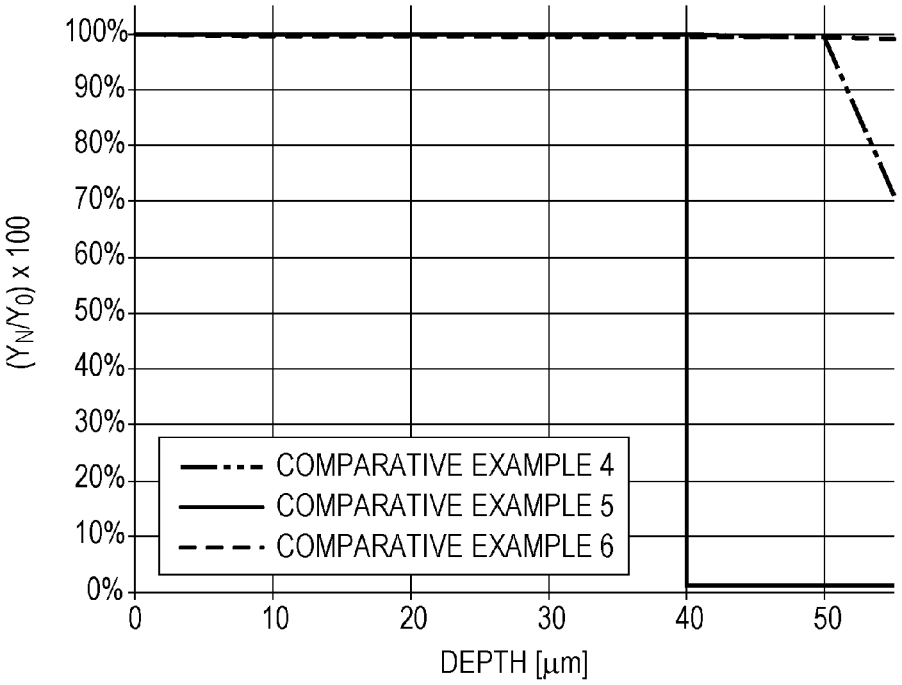
FIG. 6A shows the evaluation results of the Young's modulus of cleaning blades of Comparative Examples 4 to 6.

0.1 part (equivalent to 1000 ppm) of DABCO-TMR (Trade name) was added to 100 parts of methyl isobutyl ketone (MIBK), and then 200 parts of 4,4'-MDI was further added thereto to prepare a catalyst liquid. The prepared catalyst liquid was spray-applied to the inner surface of a die heated to 130° C. to form a polyisocyanate film with a thickness of 50 μm containing isocyanurate and unreacted MDI on the inner surface of the die. Next, a mixture of a first composition and a second composition obtained in the same manner as in Example 1 was injected into the die (inside of a cavity). After the injection, the mixture was heated at 130° C. (molding temperature) for 30 minutes to cure the mixture to generate urethane rubber, and then the urethane rubber was released from the die to give a urethane rubber plate. The obtained urethane rubber plate was cut with a cutter to form an edge portion, so that a cleaning blade containing the urethane rubber was manufactured. The obtained urethane rubber plate had a size of 2 mm in thickness, 20 mm in width, and 345 mm in length. Four kinds of blades in which the polyisocyanate film widths each were varied to 1 mm, 2 mm, 4 mm, and 6 mm from the front edge of the urethane rubber plates were created. The obtained cleaning blades were subjected to each evaluation in the same manner as in Example 1. The manufacturing conditions and the evaluation results are shown in FIG. 6A and Table 3 and 4.

Comparative Example 5

A urethane rubber plate 2 mm in thickness, 20 mm in width, and 345 mm in length was manufactured in the same manner as in Example 1, except not applying a catalyst liquid to the inner surface of a die in Example 1. Next, a contact portion (portion corresponding to a contact portion) of the manufactured urethane rubber plate was coated with a 40 μm thick nylon coat, and the resultant urethane rubber plate was used as a cleaning blade of Comparative Example 5. Four kinds of blades in which the widths of the portions coated with nylon each were varied to 1 mm, 2 mm, 4 mm, and 6 mm from the front edge of the urethane rubber plate were created. The evaluation results are shown in FIG. 6A and Tables 3 and 4.

Comparative Example 6

In Example 1, the composition of the first composition, the composition of the second composition, the molding temperature, and the composition of the catalyst liquid were changed as shown in the conditions shown in Table 1 and 2. More specifically, as the catalyst liquid, 100 parts of a mixed product of POLYCAT46 (Trade name) and quarternary ammonium salt (Trade name: TOYOCAT-TRV, manufactured by TOSOH CORP.) with a mass ratio of 3:2 was used. Except the changes, four kinds of cleaning blades different in the isocyanurated-portion width were manufactured and each evaluation was performed in the same manner as in Example 1. The manufacturing conditions and the evaluation results are shown in FIG. 6A and Tables 3 and 4.

Comparative Example 7

Figure 6B:
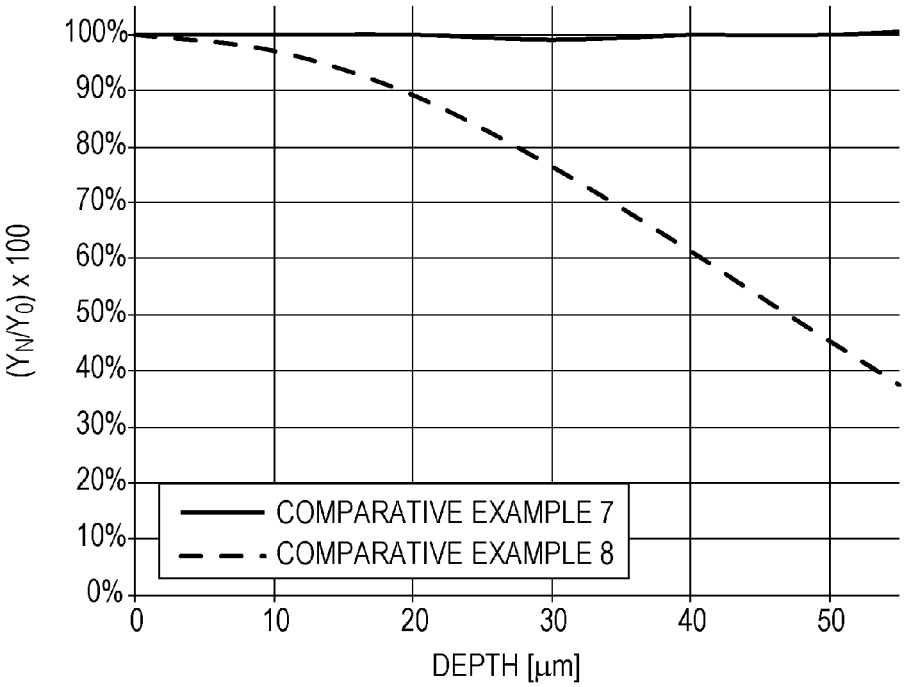
FIG. 6B shows the evaluation results of the Young's modulus of cleaning blades of Comparative Examples 7 and 8.

In this comparative example, a urethane rubber plate entirely having a uniform Young's modulus was created. In Example 1, the ETA used for the preparation of the catalyst liquid was changed to a mixture of UCAT-18X (Trade name) and DABCO-TMR (Trade name) with a mass ratio of 1:1, and then the mixture was not applied to the inner surface of a die but 0.25 part of the mixture was mixed with the second composition for use. The molding temperature was changed to 90° C. from 110° C. Except the changes, a cleaning blade was manufactured and each evaluation was performed in the same manner as in Example 1. The manufacturing conditions and the evaluation results are shown in FIG. 6B and Tables 3 and 4.

Comparative Example 8

In Example 1, the composition of the second composition, the molding temperature, and the composition of the catalyst liquid were changed as shown in the conditions shown in Table 1 and 2. More specifically, as a catalyst liquid, 100 parts of a mixture of POLYCAT46 (Trade name) and TOYOCAT-TRV (Trade name) with a mass ratio of 1:1 was used. Except the changes, four kinds of cleaning blades different in the isocyanurated-portion width were manufactured and each evaluation was performed in the same manner as in Example 1. The manufacturing conditions and the evaluation results are shown in FIG. 6B and Tables 3 and 4.

Comparative Examples 9 to 16

Comparative Examples 9 to 16 are comparative examples corresponding to Examples 1 to 8, respectively. In Examples 1 to 8, the polyvinylidene chloride sheet for coating was not used and each catalyst liquid was applied to the entire inner surface of one die. Except the changes, blades in which one side surface of a urethane rubber plate was entirely isocyanurated were manufactured and each evaluation was performed in the same manner as in Example 1. The evaluation results are shown in Table 5.

TABLE 1

| Cleaning blade | (i) First composition Polyisocyanate | | Polyol | | (ii) Second composition Polyol | | Catalyst for urethane rubber synthesis | | M(OH/NCO) in mixture of (i) and (ii) [mol %] |
|---|---|---|---|---|---|---|---|---|---|
| Example 1 | 4,4'-MDI | 299 part(s) | BA2600 | 767.5 part(s) | HA2000 | 300 part(s) | ETA | 0.25 part(s) | 17 |
| Example 2 | 4,4'-MDI | 299 part(s) | BA2600 | 767.5 part(s) | HA2000 | 300 part(s) | ETA | 0.25 part(s) | 17 |
| Example 3 | 4,4'-MDI | 299 part(s) | BA2600 | 767.5 part(s) | HA2000 | 300 part(s) | ETA | 0.25 part(s) | 17 |
| Example 4 | 4,4'-MDI | 299 part(s) | BA2600 | 767.5 part(s) | HA2000 | 360 part(s) | ETA | 0.25 part(s) | 20 |
| Example 5 | 4,4'-MDI | 350 part(s) | BA2600 | 860 part(s) | HA2000 | 170 part(s) | ETA | 0.25 part(s) | 8 |
| Example 6 | 4,4'-MDI | 299 part(s) | BA2600 | 767.5 part(s) | HA2000 | 218.5 part(s) | ETA | 0.25 part(s) | 12 |
| Example 7 | 4,4'-MDI | 299 part(s) | BA2600 | 767.5 part(s) | HA2000 | 218.5 part(s) | ETA | 0.25 part(s) | 12 |
| Example 8 | 4,4'-MDI | 299 part(s) | BA2600 | 767.5 part(s) | HA2000 | 170 part(s) | ETA | 0.25 part(s) | 8 |
| Comparative Example 1 | 4,4'-MDI | 299 part(s) | BA2600 | 767.5 part(s) | HA2000 | 500 part(s) | ETA | 0.25 part(s) | 28 |
| Comparative Example 2 | 4,4'-MDI | 350 part(s) | BA2600 | 860 part(s) | HA2000 | 150 part(s) | ETA | 0.25 part(s) | 7 |

TABLE 1-continued

| Cleaning blade | (i) First composition Polyisocyanate | | Polyol | | (ii) Second composition Polyol | | Catalyst for urethane rubber synthesis | | M(OH/NCO) in mixture of (i) and (ii) [mol %] |
|---|---|---|---|---|---|---|---|---|---|
| Comparative Example 3 | 4,4'-MDI | 299 part(s) | BA2600 | 767.5 part(s) | HA2000 | 300 part(s) | ETA | 0.25 part(s) | 17 |
| Comparative Example 4 | — | — | — | — | — | — | — | — | — |
| Comparative Example 5 | 4,4'-MDI | 299 part(s) | BA2600 | 767.5 part(s) | HA2000 | 300 part(s) | ETA | 0.25 part(s) | 17 |
| Comparative Example 6 | 4,4'-MDI | 299 part(s) | BA2600 | 800 part(s) | HA2000 | 450 part(s) | ETA | 0.28 part(s) | 25 |
| Comparative Example 7 | 4,4'-MDI | 299 part(s) | BA2600 | 767.5 part(s) | HA2000 | 300 part(s) | ETA | 0.25 part(s) | 17 |
| Comparative Example 8 | 4,4'-MDI | 299 part(s) | BA2600 | 767.5 part(s) | HA2000 | 380 part(s) | ETA | 0.25 part(s) | 21 |

TABLE 2

| Cleaning blade | Catalyst liquid | | | Molding temperature [° C.] |
|---|---|---|---|---|
| Example 1 | Ethanol<br>ETA | 100 part(s)<br>100 part(s) | Applied to inner surface of die | 110 |
| Example 2 | Ethanol<br>DABCO-TMR | 100 part(s)<br>100 part(s) | Applied to inner surface of die | 80 |
| Example 3 | Ethanol<br>UCAT-18X | 100 part(s)<br>100 part(s) | Applied to inner surface of die | 150 |
| Example 4 | Ethanol<br>POLYCAT46 | 100 part(s)<br>100 part(s) | Applied to inner surface of die | 110 |
| Example 5 | Ethanol<br>UCAT-18X<br>DABCO-TMR | 100 part(s)<br>50 part(s)<br>50 part(s) | Applied to inner surface of die | 90 |
| Example 6 | Ethanol<br>UCAT-18X | 100 part(s)<br>100 part(s) | Applied to inner surface of die | 100 |
| Example 7 | Ethanol<br>UCAT-18X | 100 part(s)<br>100 part(s) | Applied to inner surface of die | 110 |
| Example 8 | Ethanol<br>POLYCAT46 | 100 part(s)<br>100 part(s) | Applied to inner surface of die | 80 |
| Comparative Example 1 | Ethanol<br>ETA | 100 part(s)<br>100 part(s) | Applied to inner surface of die | 140 |
| Comparative Example 2 | Ethanol<br>UCAT-18X | 100 part(s)<br>100 part(s) | Applied to inner surface of die | 110 |
| Comparative Example 3 | — | — | — | 110 |
| Comparative Example 4 | MIBK<br>DABCO-TMR<br>4,4'-MDI | 100 part(s)<br>0.1 part(s)<br>200 part(s) | Applied to inner surface of die | 130 |
| Comparative Example 5 | — | — | — | 110 |
| Comparative Example 6 | Ethanol<br>POLYCAT46<br>TOYOCAT-TRV | 100 part(s)<br>60 part(s)<br>40 part(s) | Applied to inner surface of die | 100 |
| Comparative Example 7 | Ethanol<br>UCAT-18X<br>DABCO-TMR | 100 part(s)<br>50 part(s)<br>50 part(s) | Added (0.25 part(s)) to second composition | 90 |
| Comparative Example 8 | Ethanol<br>POLYCAT46<br>TOYOCAT-TRV | 100 part(s)<br>50 part(s)<br>50 part(s) | Applied to inner surface of die | 100 |

TABLE 3

| | Young's Modulus | | | | | | | | | Young's Modulus |
|---|---|---|---|---|---|---|---|---|---|---|
| | $Y_0$ [mgf/μm2] | $Y_{20}$ [mgf/μm2] | $Y_{50}$ [mgf/μm2] | $Y_{50}/Y_0$ | $Y_{20}/Y_0$ | $\Delta Y_{0\text{-}20}$ | $\Delta Y_{20\text{-}50}$ | Position of $Y_N$ to $L_{0\text{-}50}$ | $I_{SI}/I_{SE}$ | $P_0$ in region B |
| Example 1 | 42 | 20 | 8 | 0.2 | 0.5 | 0.03 | 0.01 | Under $L_{0\text{-}50}$ | 0.5 | 1.2 |
| Example 2 | 250 | 110 | 31 | 0.1 | 0.4 | 0.03 | 0.01 | Under $L_{0\text{-}50}$ | 1.2 | 2.6 |
| Example 3 | 158 | 22 | 5 | 0 | 0.1 | 0.04 | 0 | Under $L_{0\text{-}50}$ | 0.91 | 2.5 |

TABLE 3-continued

| | Young's Modulus | | | | | | | | | Young's Modulus |
|---|---|---|---|---|---|---|---|---|---|---|
| | $Y_0$ [mgf/μm2] | $Y_{20}$ [mgf/μm2] | $Y_{50}$ [mgf/μm2] | $Y_{50}/Y_0$ | $Y_{20}/Y_0$ | $\Delta Y_{0\text{-}20}$ | $\Delta Y_{20\text{-}50}$ | Position of $Y_N$ to $L_{0\text{-}50}$ | $I_{SI}/I_{SE}$ | $P_0$ in region B |
| Example 4 | 10 | 8 | 5 | 0.5 | 0.8 | 0.01 | 0.01 | Almost overlapped | 0.61 | 1.1 |
| Example 5 | 161 | 113 | 48 | 0.3 | 0.7 | 0.015 | 0.013 | Almost overlapped | 0.85 | 2.2 |
| Example 6 | 400 | 189 | 78 | 0.2 | 0.5 | 0.03 | 0.01 | Under $L_{0\text{-}50}$ | 1.55 | 4 |
| Example 7 | 344 | 148 | 61 | 0.2 | 0.4 | 0.03 | 0.01 | Under $L_{0\text{-}50}$ | 1.35 | 3.5 |
| Example 8 | 35 | 23 | 10 | 0.3 | 0.7 | 0.016 | 0.012 | Under $L_{0\text{-}50}$ | 0.54 | 10 |
| Comparative Example 1 | 6 | 5 | 3 | 0.5 | 0.8 | 0.01 | 0.01 | Above $L_{0\text{-}50}$ | 0.49 | 1.4 |
| Comparative Example 2 | 457 | 360 | 194 | 0.4 | 0.8 | 0.01 | 0.01 | Above $L_{0\text{-}50}$ | 1.9 | 2.3 |
| Comparative Example 3 | 11 | 8.9 | 8 | 0.7 | 0.8 | 0.01 | 0 | Under $L_{0\text{-}50}$ | 0.12 | 2.5 |
| Comparative Example 4 | 886 | 886 | 880 | 1 | 1 | 0 | 0 | Above $L_{0\text{-}50}$ | 4.8 | 2 |
| Comparative Example 5 | 230 | 230 | 3 | 0 | 1 | 0 | 0.033 | Above $L_{0\text{-}50}$ | 0.05 | 2.5 |
| Comparative Example 6 | 14 | 14 | 14 | 1 | 1 | 0 | 0 | Above $L_{0\text{-}50}$ | 0.14 | 14 |
| Comparative Example 7 | 115 | 115 | 115 | 1 | 1 | 0 | 0 | — | 0.21 | 115 |
| Comparative Example 8 | 79 | 70 | 36 | 0.5 | 0.9 | 0.0057 | 0.014 | Above $L_{0\text{-}50}$ | 0.84 | 2.3 |

TABLE 4

| | Smooth photosensitive drum (Squeaking evaluation) | | | | Concave photosensitive drum (Passing-through evaluation) |
|---|---|---|---|---|---|
| | Treated width | | | | |
| | 1 mm | 2 mm | 4 mm | 6 mm | 1 mm |
| | d | | | | |
| | 7 mm | 6 mm | 4 mm | 2 mm | 7 mm |
| Example 1 | A | A | A | B | A |
| Example 2 | A | A | A | A | A |
| Example 3 | A | A | A | B | A |
| Example 4 | A | A | A | B | B |
| Example 5 | A | A | A | A | B |
| Example 6 | A | A | A | A | B |
| Example 7 | A | A | A | B | A |
| Example 8 | A | A | A | B | B |
| Comparative Example 1 | E | E | E | E | D |
| Comparative Example 2 | A | A | B | B | C |
| Comparative Example 3 | A | A | A | B | C |
| Comparative Example 4 | A | A | A | B | C |
| Comparative Example 5 | A | A | B | B | C |
| Comparative Example 6 | A | A | A | B | C |
| Comparative Example 7 | | D | | | C |
| Comparative Example 8 | A | A | A | A | C |

TABLE 5

| | Smooth photosensitive drum (Squeaking evaluation) | Concave photosensitive drum (Passing-through evaluation) |
|---|---|---|
| Comparative Example 9 | C | A |

TABLE 5-continued

| | Smooth photosensitive drum (Squeaking evaluation) | Concave photosensitive drum (Passing-through evaluation) |
|---|---|---|
| Comparative Example 10 | C | A |
| Comparative Example 11 | C | A |
| Comparative Example 12 | C | B |
| Comparative Example 13 | C | B |
| Comparative Example 14 | C | B |
| Comparative Example 15 | C | A |
| Comparative Example 16 | C | B |

Consideration

In Examples 1 to 8 in which the relationship between the expressions (1), (2), (3), and (4) is satisfied and also the isocyanurated-portion width is limited, squeaking of the cleaning blades is suppressed. In particular, when the isocyanurated-portion width is 4 mm or less and the shortest distance d between the isocyanurated portion and the support member is 4 mm or more, squeaking is completely suppressed. Moreover, since these cleaning blades follow well to surface unevenness of the photoconductor drum, the evaluation results of passing-through to the concave photoconductor drum are also good.

Figure 8:
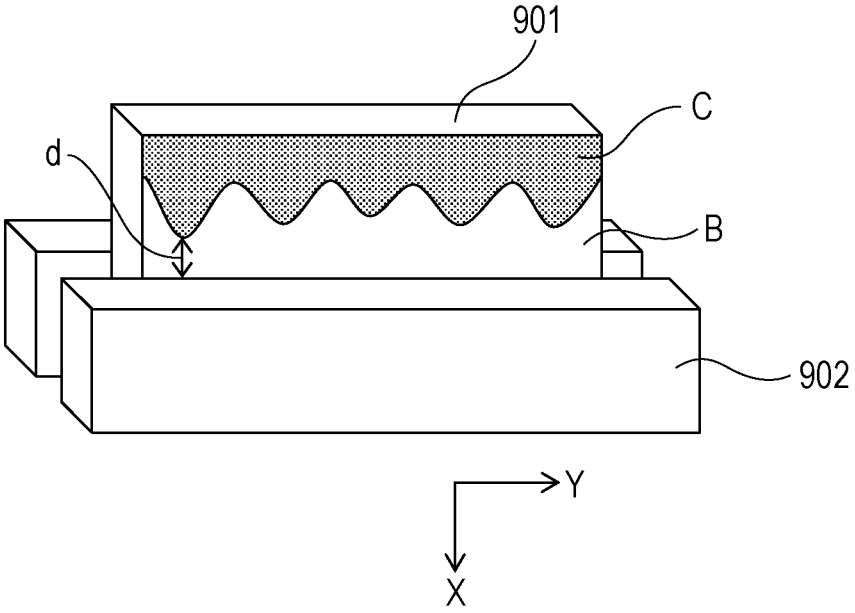
FIG. 8 is a view illustrating an example in which the region C is formed in such a manner that the width varies in the longitudinal direction of a cleaning blade.

Moreover, Examples show the results in the blades in which the isocyanurated-portion (region C) width was constant (fixed) in the longitudinal direction of the blades. Furthermore, as illustrated in FIG. 8, using the blade in which the region C width is varied in the longitudinal direction of the blade and dispersing the resonance frequency of low frequency squeaking, the squeaking suppressing effect can be further demonstrated in some cases. Also in this case, due to the fact that the region B is similarly interposed between the blade support member 902 and the region C and the "shortest distance d" between the support member 902 and the region C is set to 4 mm or more, the effects of the present invention are further demonstrated.

In Examples, the holding type blade illustrated in FIG. 2A was used but the same effects are demonstrated also in blades of the other configurations illustrated in FIG. 1 and FIGS. 2B and 2C.

Moreover, although the electrophotographic photoconductor is described as the member to be cleaned in Examples, the effects of the present invention are demonstrated also when an intermediate transfer body, a transfer roller, and the like are used as the member to be cleaned.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-222033, filed Oct. 30, 2014 which is hereby incorporated by reference herein in its entirety.

What is claimed is:

1. A cleaning blade for cleaning a surface of a member to be cleaned by bringing the elastic body portion into contact with the surface of the member to be cleaned, the cleaning blade comprising:

an elastic body portion containing urethane rubber; and a support member supporting the elastic body portion, wherein a free end portion of the elastic body includes a first region in which a Young's modulus gradually decreases in a depth direction from a principal surface facing the surface of the member to be cleaned on an edge face side, and a second region in which the Young's modulus does not vary in the depth direction from the principal surface on a side closer to the support member relative to the first region, and when Young's moduli of the principal surface and a position at a depth of 20 μm and a position at a depth of 50 μm from the principal surface are defined as $Y_0$, $Y_{20}$, and $Y_{50}$, respectively, in the first region, an average rate of variation of the Young's modulus $\Delta Y_{0\text{-}20}$ between the principal surface and the position at the depth of 20 μm from the principal surface is represented by Expression (5) shown below, an average rate of variation of the Young's modulus $\Delta Y_{20\text{-}50}$ between the position at the depth of 20 μm from the principal surface and the position at the depth of 50 μm from the principal surface is represented by Expression (6) shown below, and the Young's modulus of a surface in the second region on a same plane as the principal surface is defined as $P_0$, relationships of the following expressions (1), (2), (3), and (4) are satisfied:

$$10\ \text{mgf}/\mu\text{m}^2 \leq Y_0 \leq 400\ \text{mgf}/\mu\text{m}^2 \quad (1),$$

$$Y_{50}/Y_0 \leq 0.5 \quad (2),$$

$$\Delta Y20\text{-}50 \leq \Delta Y0\text{-}20 \quad (3),$$

$$P0 < Y0 \quad (4),$$

$$\Delta Y_{0\text{-}20} = \{(Y_0 - Y_{20})/Y_0\}/(20-0)\ \mu\text{m} \quad (5), \text{ and}$$

$$\Delta Y_{20\text{-}50} = \{(Y_{50} - Y_{20})/Y_{20}\}/(50-20)\ \mu\text{m} \quad (6).$$

2. The cleaning blade according to claim 1, wherein the Young's modulus $P_0$ is 1 mgf/μm$^2$ or more and 5 mgf/μm$^2$ or less.

3. The cleaning blade according to claim 1, wherein a shortest distance d between the first region and the support member is 4 mm or more and 10 mm or less.

4. The cleaning blade according to claim 1, wherein the first region is formed in such a manner that a width varies in a longitudinal direction of the cleaning blade.

5. The cleaning blade according to claim 1, wherein, when a graph in which a horizontal axis represents a distance from the principal surface and a vertical axis represents the Young's Modulus in the first region is drawn, a Young's modulus $Y_N$ at an arbitrary position (position N [μm] apart from the principal surface) in a range from the principal surface to the position at the depth of 50 μm (0<N<50 [μm]) is located under a straight line connecting the Young's modulus $Y_0$ and the Young's modulus $Y_{50}$.

6. A cleaning device, comprising the cleaning blade according to claim 1.

* * * * *